US010724284B2

(12) United States Patent
Collene

(10) Patent No.: US 10,724,284 B2
(45) **Date of Patent: *Jul. 28, 2020**

(54) APPLIANCE LID HINGE ASSEMBLY WITH SNUBBER

(71) Applicant: Mansfield Engineered Components, Inc., Mansfield, OH (US)

(72) Inventor: James Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/342,830

(22) Filed: Nov. 3, 2016

(65) Prior Publication Data

US 2017/0122020 A1 May 4, 2017

Related U.S. Application Data

(60) Provisional application No. 62/250,244, filed on Nov. 3, 2015.

(51) Int. Cl.

| | |
|---|---|
| ***E05F 3/10*** | (2006.01) |
| ***D06F 39/14*** | (2006.01) |
| *D06F 37/18* | (2006.01) |
| *D06F 37/24* | (2006.01) |
| *D06F 58/20* | (2006.01) |

(52) U.S. Cl.

CPC ..... *E05F 3/104* (2013.01); *D06F 39/14* (2013.01); *D06F 37/18* (2013.01); *D06F 37/24* (2013.01); *D06F 58/20* (2013.01); *E05Y 2201/21* (2013.01); *E05Y 2201/264* (2013.01); *E05Y 2900/30* (2013.01); *E05Y 2900/312* (2013.01)

(58) Field of Classification Search

CPC ..... E05F 3/20; E05F 3/10; E05F 3/18; E05F 1/1276; E05F 1/1269; E05F 1/1058; E05F 1/105; D06F 37/28; D06F 58/20; E05D 7/00; E05Y 2900/312

USPC ..... 312/319.2

See application file for complete search history.

(56) References Cited

U.S. PATENT DOCUMENTS

| | | | | |
|---|---|---|---|---|
| 1,706,656 A * | 3/1929 | Collins | ..... | E05F 3/20 16/68 |
| 3,256,554 A | 6/1966 | Turner | | |
| 3,496,595 A * | 2/1970 | Larson | ..... | E05F 1/1261 16/289 |

(Continued)

OTHER PUBLICATIONS

Letter regarding Co-Pending U.S. Appl. No. 15/344,215, filed Nov. 4, 2016.

*Primary Examiner* — Daniel J Troy
*Assistant Examiner* — Timothy M Ayres
(74) *Attorney, Agent, or Firm* — Fay Sharpe LLP

(57) ABSTRACT

A hinge assembly for pivotally connecting an associated appliance lid to an associated appliance body includes a base adapted to be connected to the associated appliance body. A cam is rotatably supported on the base and is adapted to be engaged by the associated appliance lid and is rotatable about a lid pivot axis. A snubber/damper is operatively connected to the base. The cam exerts a snubber activation force on the snubber when said cam rotates about the lid pivot axis in a first direction corresponding to movement of the associated appliance lid from an opened position toward a closed position such that the snubber damps movement of the cam when the cam rotates in the first direction.

6 Claims, 5 Drawing Sheets

(56) References Cited

U.S. PATENT DOCUMENTS 3,737,947 A 6/1973 Little
4,947,516 A * 8/1990 Kretchman ..... D06F 39/14 16/289
5,269,043 A 12/1993 Yang
6,415,477 B1 * 7/2002 Hosaka ..... E05F 1/1261 16/284
6,679,572 B2 * 1/2004 Sears ..... D06F 39/14 312/319.2
6,721,991 B2 * 4/2004 Dioguardi ..... G02C 5/2227 16/228
6,766,563 B2 * 7/2004 Lee ..... A23B 7/0425 16/281
6,845,545 B2 * 1/2005 Han ..... E05F 1/1269 16/277
7,243,396 B2 7/2007 Vanini
7,552,509 B2 * 6/2009 Chen ..... E05F 5/006 16/286
7,676,888 B2 * 3/2010 Vanini ..... E05F 1/1261 16/277
7,861,371 B2 * 1/2011 Kim ..... E05F 5/10 16/52
7,937,807 B2 * 5/2011 Bereznai ..... E05F 5/10 16/82
8,096,455 B2 1/2012 Viklund et al.
8,250,706 B2 8/2012 Vanini
8,443,489 B2 5/2013 Sir Louis
8,991,010 B2 3/2015 Brunnmayr
9,080,365 B2 * 7/2015 Collene ..... E05F 1/1261
9,121,211 B1 * 9/2015 White ..... E05F 3/20
9,169,681 B2 10/2015 Cooper et al.
9,181,741 B2 11/2015 Bettinzoli
9,394,645 B2 * 7/2016 Park ..... D06F 39/14
2006/0053589 A1 3/2006 Vanini
2007/0251052 A1 * 11/2007 Pyo ..... E05F 5/02 16/86 A
2009/0064458 A1 3/2009 Vanini
2010/0281650 A1 * 11/2010 Kleemann ..... A47L 15/4261 16/64
2011/0094056 A1 * 4/2011 Lautenschlager ..... E05F 5/02 16/84
2011/0298349 A1 12/2011 Sutterlutti
2013/0239364 A1 9/2013 Sir Louis
2014/0345082 A1 * 11/2014 Collene ..... E05F 1/1058 16/58
2015/0354261 A1 * 12/2015 Dora ..... F24C 15/023 49/31
2017/0030125 A1 * 2/2017 Bacchetti ..... E05F 3/10
2017/0130502 A1 * 5/2017 Collene ..... E05F 3/20
2017/0254133 A1 * 9/2017 Liang ..... E05D 5/065
2018/0010377 A1 * 1/2018 Bacchetti ..... E05F 3/10

* cited by examiner

APPLIANCE LID HINGE ASSEMBLY WITH SNUBBER

CROSS-REFERENCE TO RELATED APPLICATION

This application claims priority from and benefit of the filing date of U.S. provisional application Ser. No. 62/250,244 filed Nov. 3, 2015, and the entire disclosure of said provisional application is hereby expressly incorporated by reference into the present specification.

BACKGROUND

Top-loading appliances such as clothes washing and drying machines include a lid that pivots about a horizontal pivot axis between an opened and a closed position. When pivoted upward to the opened position, the lid is moved away from and provides access to a chamber for washing or drying clothes or for another purpose that varies depending upon the function of the appliance. When pivoted downward to the closed position, the lid is moved into abutment with the appliance body and covers an open mouth or entrance of the chamber in order for the appliance to function properly, quietly, safely, and efficiently. Because movement of the lid from its opened position to its closed position is associated with pivoting movement of the lid downward as aided by gravity, it has been deemed desirable to prevent harsh closing or "slamming" of the lid as it closes. As such, a need has been identified for a lid hinge assembly for a top-loading appliance that dampens or cushions movement of the lid as it moves to its closed position but that also fits within a small envelope, is self-contained so as to be easily installed or replaced, is cost-effective, and that is sufficiently durable to withstand heavy use over many years in a damp environment of variable temperature.

Another drawback associated with known damping systems for top-loading appliances is that the damping mechanism prevents the lid from completely and tightly closing and abutting the appliance body when the lid is moved to its closed position, which has undesired effects on aesthetics, safety, noise, and overall operation of the appliance. For example, if the appliance control system senses that the lid is opened, the control system will sometimes interrupt the clothes washing, drying, or other operation being performed as a safety feature. As such, a need has been identified for a damping system for the lid of a top-loading appliance that provides effective damping without inhibiting complete closing of the lid.

SUMMARY

In accordance with one aspect of the present development, a hinge assembly for pivotally connecting an associated appliance lid to an associated appliance body includes a base adapted to be connected to the associated appliance body. A cam is rotatably supported on the base and is adapted to be engaged by the associated appliance lid and is rotatable about a lid pivot axis. A snubber/damper is operatively connected to the base. The cam exerts a snubber activation force on the snubber when said cam rotates about the lid pivot axis in a first direction corresponding to movement of the associated appliance lid from an opened position toward a closed position such that the snubber damps movement of the cam when the cam rotates in the first direction.

DETAILED DESCRIPTION

Figure 1:
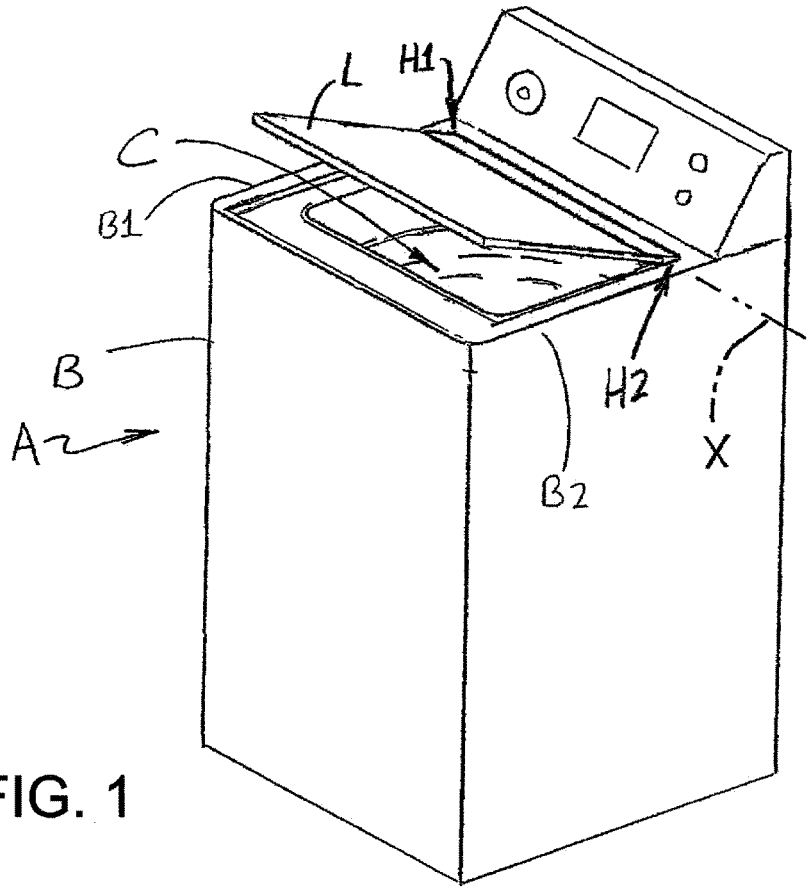
FIG. 1 is an isometric view of a top-loading appliance such as a clothes washing machine including a lid that is pivotally connected to a body by at least one lid hinge assembly provided in accordance with the present development.

FIG. 1 shows a top-loading appliance A such as a clothes washing machine or dryer. The appliance A includes a body B and a lid L that is pivotally connected to the body B and adapted for pivoting movement relative to the body about a horizontal pivot axis X between a closed position, where the lid L covers or blocks access to a chamber C located inside the body, and an opened position, in which the lid L is moved to a position where it uncovers or opens and allows access to the chamber C. FIG. 1 shows the lid L in a partially opened position located between the closed position (also referred to as the fully closed position) and an opened position (also referred to as the fully opened position). Typically, the fully opened position of the lid is slightly greater than 90 degrees away from the closed position.

The lid L is operatively secured to the body B for such pivoting movement by a first hinge or hinge assembly H1 located adjacent a first lateral side of the lid L/body B and a second hinge or hinge assembly H2 located adjacent a second lateral side of the lid L/body B (the hinge assemblies H1,H2 are sometimes generally referred to herein as hinge assemblies H). Either one or both of the hinge assemblies H1,H2 are provided in accordance with the present development as described herein.

Figure 2:
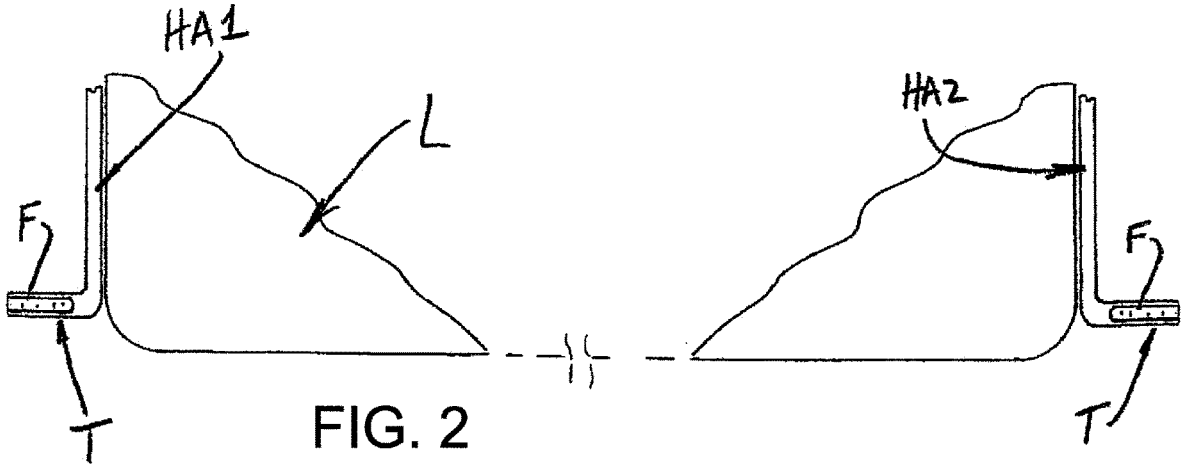
FIG. 2 is a partial view of the lid of the appliance of FIG. 1 by itself and shows that the lid includes first and second hinge arms connected respectively to opposite first and second lateral sides of the lid.

FIG. 2 shows the lid by itself, and it can be seen that first and second hinge arms HA1,HA2 are connected respectively to opposite first and second lateral sides of the lid L, respectively. Each hinge arm HA1,HA2 comprises a metal wire form or like structure secured to or otherwise provided as part of the lid L and comprising a tip T that projects transversely outward away from the lid. Each tip T includes one or more flats F or is otherwise defined with a non-circular cross-section for non-rotatable engagement with the respective mating hinge assembly H1,H2 (see also FIG. 3) connected to the appliance body B as described below for pivotally securing the lid L to the body B. The hinge arms HA1,HA2 can have other structures or be defined from other materials, e.g., the hinge arms can be provided by a metal or molded polymeric stud connected to or provided as part of the lid L and projecting outwardly therefrom. Each hinge assembly H can alternatively be referred to as a motion control assembly, in which case the hinge arms HA1,HA2 can each be referred to as a hinge that engages the motion control assembly H.

FIGS. 3A-3F (collectively referred to herein as FIG. 3) provide six different views of a hinge assembly H (H1,H2) provided in accordance with the present development. The hinge assembly H is optionally constructed to be ambidextrous in that it functions as either a first hinge assembly H1 or the second hinge assembly H2, depending upon where it is mounted to the appliance body B, i.e., the hinge assembly H is mounted adjacent a first lateral side B1 of the body B and chamber C to be engaged by the first lid hinge arm HA1 when acting as a first hinge assembly H1, and the hinge assembly H is mounted adjacent an opposite second lateral side B2 of the body B and chamber C to be engaged by the second lid hinge arm HA2 when acting as a second hinge assembly H2. Alternatively, the hinge assembly H illustrated in FIG. 3 is a first hinge assembly H1 only (or a second hinge assembly H2 only) in which case the second hinge assembly H2 (or the first hinge assembly H1) is constructed as a mirror image of the illustrated hinge assembly H.

The hinge assembly H comprises a base 10 preferably defined as a unitary or one-piece molded polymeric structure including a mounting flange 12 comprising one or more apertures 14 that receive a rivet, screw or like fastener for operatively securing the base to the appliance body B. Alternatively, the base 10 is a metal structure and/or is assembled from multiple pieces of metal and/or polymeric material.

An outer or upper portion 15 of the base 10 comprises a notch or other recess 18, and the hinge assembly H further comprises a cam 20 located in the notch 18 and adapted for rotation in first and second opposite directions, with the first direction corresponding to movement of the lid L from its opened position toward its closed position, and the second direction corresponding to movement of the lid L from its closed position toward its opened position. More particularly, the upper portion 15 of the base 10 comprises first and second parallel, spaced-apart support walls 16*a*,16*b* that define a space or slot 16*s* there between. The walls 16*a*,16*b* include respective notches or recesses 18*a*,18*b* that are aligned or registered with each other to provide or define the notch/recess 18 in which the cam 20 is received and rotatably supported. In an alternative embodiment, one or both of the notches or recesses 18*a*,18*b* are provided by or comprise a hole or aperture with an enclosed perimeter and in which the opposite ends of the cam are respectively supported for rotation relative to the base 10.

The cam 20 comprises a camshaft 22 having its opposite ends respectively supported for rotation in the notches 18*a*,18*b*, and the cam 20 further comprises a cam lobe, ear, tab, or other projection 24 that extends or projects radially outwardly from the camshaft 22 between its opposite ends. The cam lobe 24 is located in the space 16*s* defined between the support walls 16*a*,16*b* for at least certain angular positions of the cam 20. The camshaft 22 rotates in the recess 18 relative to the base 10 about the axis of rotation X.

At least one or both opposite ends of the camshaft 22 are adapted to be connected to one of the lid hinge arms HA1,HA2 such that the hinge arm HA1,HA2 and the camshaft 22 rotate together about the axis of rotation X. In the illustrated embodiment, the opposite ends of the camshaft 22 include respective non-circular apertures or recesses 23 that non-rotatably receive and mate with the tip T of an associated hinge arm HA1,HA2 in a non-rotatable or keyed manner, but other mating connections between a hinge arm HA1,HA2 and the camshaft 22 can be used. When the tip T of an appliance lid hinge arm HA1,HA2 is mated with one of the cam apertures 23, the cam 20 rotates in response to pivoting movement of the lid between its opened and closed positions. In an alternative embodiment, the cam 20 is provided as part of a hinge arm HA1,HA2, for example the cam 20 is provided as a one-piece construction with or otherwise connected to the remainder of the hinge arm HA1,HA2, in which case the lid L is connected directly to the hinge assembly H when secured to the hinge arm HA1,HA2 by one or more fasteners, welding, and/or otherwise.

Figure 3A:
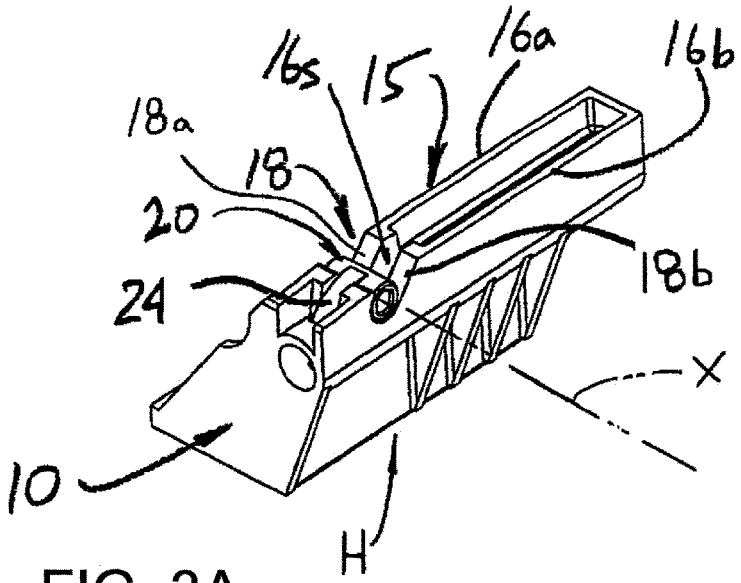
FIG. 3A is a front isometric view of a hinge assembly with a snubber in accordance with an embodiment of the present development.
Figure 3B:
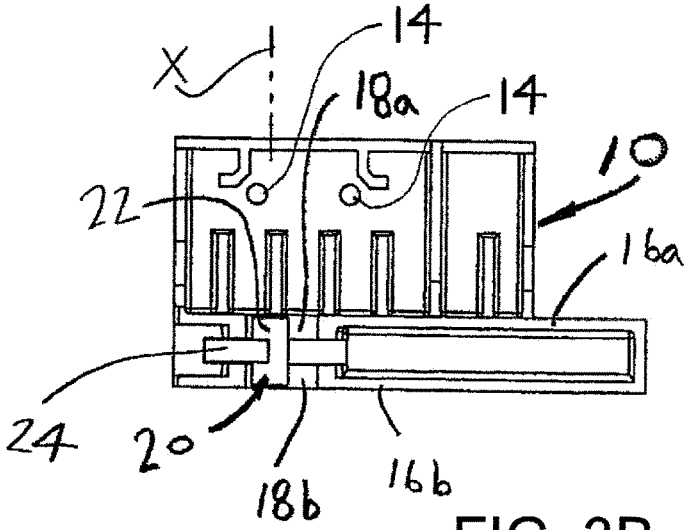
FIG. 3B is a top plan view of the hinge assembly of FIG. 3A.
Figure 3C:
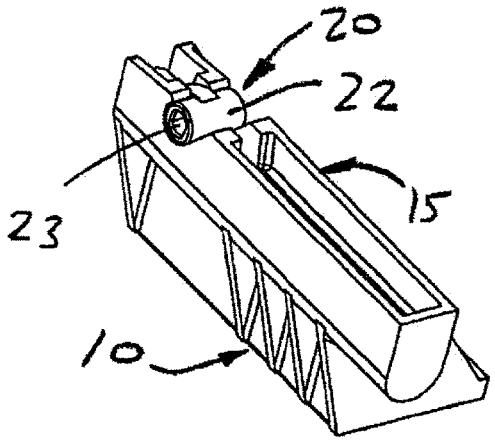
FIG. 3C is a rear isometric view of the hinge assembly of FIG. 3A.
Figure 3D:
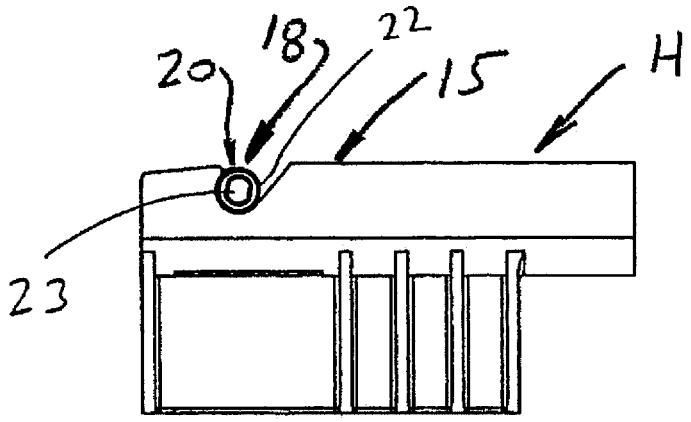
FIG. 3D is a right side view of the hinge assembly of FIG. 3A.
Figure 3E:
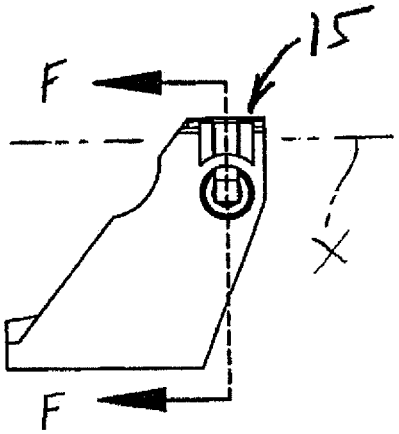
FIG. 3E is a front view of the hinge assembly of FIG. 3A.
Figure 3F:
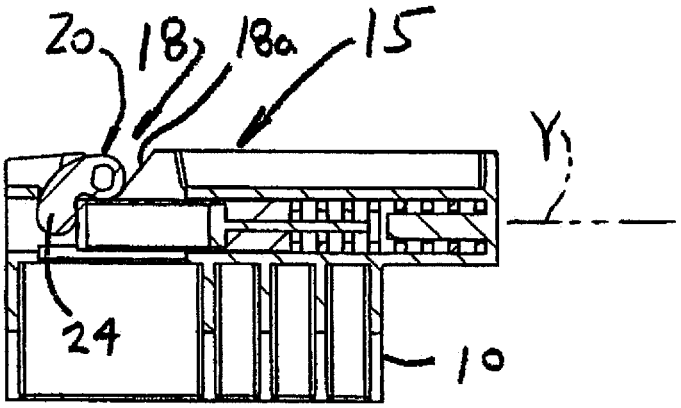
FIG. 3F is a section view of the hinge assembly of FIG. 3A as taken at F-F in FIG. 3E.
Figure 4A:
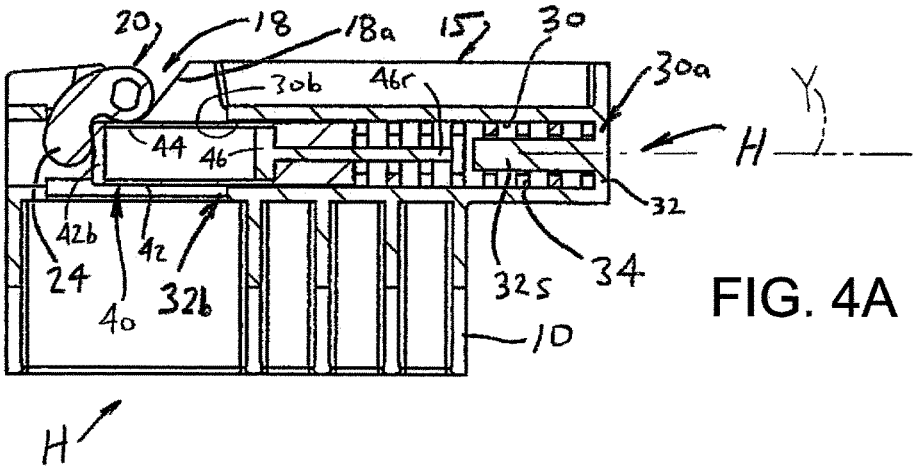
FIGS. 4A, 4B, and 4C are section views corresponding to FIG. 3F and respectively show the hinge assembly in first, intermediate, and second positions corresponding respectively to an opened position of the appliance lid (FIG. 4A), a partially opened (or partially closed) position of the appliance lid (FIG. 4B), and a closed or fully closed position of the appliance lid (FIG. 4C)
Figure 4B:
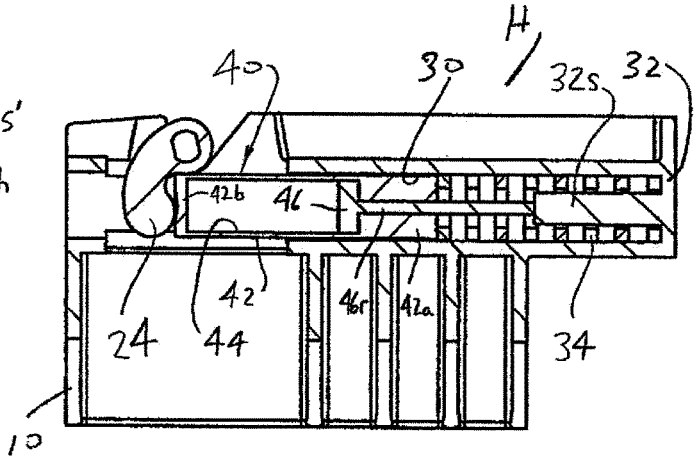
Figure 4C:
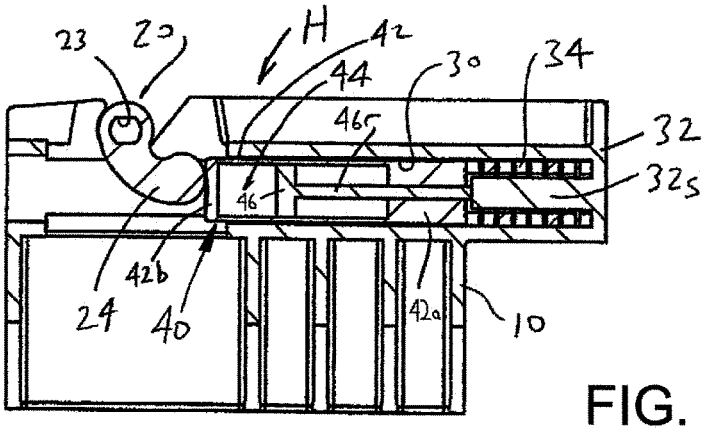

FIG. 4A is a cross-section of the hinge assembly H as taken at line F-F of FIG. 3E that shows the hinge assembly H in a first position corresponding to a fully opened position of the appliance lid L. FIG. 4C is similar to FIG. 4A but shows the hinge assembly H in a second position where the cam 20 has been rotated to a position corresponding to the appliance lid L being fully closed. FIG. 4B is similar to FIGS. 4A and 4C but shows the hinge assembly H in an intermediate position where the cam 20 has been rotated to a position corresponding to the appliance lid being partially opened or partially closed, i.e., the lid L is located partially between its fully opened and closed positions. Comparing FIGS. 4A-4C, it can be seen that rotation of the cam 20 causes the cam lobe 24 to move to and between a first position (FIG. 4A), an intermediate position (FIG. 4B), and a second position (FIG. 4C).

A hinge assembly H provided in accordance with the present development includes at least one shock-absorber, damper, or other "snubber" 40 that is connected to and operatively supported by the base 10. The snubber 40 is contacted by the cam lobe 24 for at least part of the arc on which the cam lobe 24 moves in a first rotational direction from its first position (FIG. 4A) toward its second position (FIG. 4C) during movement of the appliance lid L from an opened position to the closed position, and the snubber 40 resists movements of the cam lobe 24 in the first direction when it is contacted by the cam lobe 24 which, in turn, damps movement and prevents slamming of the lid L when it moves from an opened position to the closed position and contacts the appliance body B.

In FIG. 4A, its can be seen that the hinge assembly base 10 comprises a laterally or horizontally extending snubber installation bore 30. A first end 30*a* of the bore 30 is closed by a bore inner wall or bore end wall 32 or is otherwise partially or fully occluded, and the opposite second end 30*b* of the bore 30 is open and intersects/communicates with the slot 16*s* of the base in which the cam lobe 24 moves. A primary spring 34 such as a coil spring is located in the closed end 30*a* of the bore 30 and is abutted with the bore inner wall 32. In the illustrated embodiment, an optional locating peg or locating stud 32*s* projects into the bore 30 from the bore inner wall 32 and the primary spring 34 is coaxially positioned about the stud 32*s* such that the stud 32*s* extends into the hollow core of the primary spring 34 to maintain proper location and alignment of the spring 34 in the bore 30 and to provide a reaction structure or surface against with the snubber 40 acts, but the locating stud 32*s* can be omitted in which case the bore inner wall 32 provides the reaction surface for the snubber 40. Alternatively the base includes a larger snubber installation bore 30 or multiple parallel snubber installation bores 30, and two or more parallel snubbers 40 are located in the single or multiple installation bore(s) 30, wherein both snubbers 40 are operatively engaged by the cam 20 as described herein for the single snubber 40.

Figure 5A:
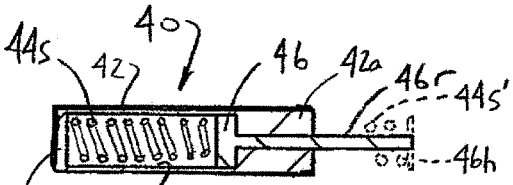
FIGS. 5A and 5B show one example of a suitable snubber used in the hinge assembly of FIG. 3A, which is a self-contained damper cylinder that uses air, oil or another damping fluid and/or that uses a mechanical spring for damping.
Figure 5B:
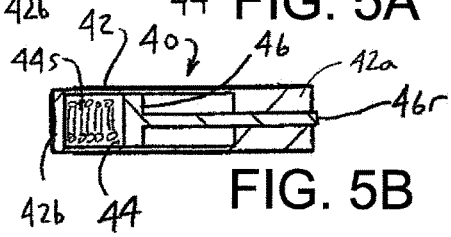

In the illustrated embodiment, the snubber 40 is located in the bore 30 and acts as a damper to counteract or attenuate closing force acting on the appliance lid L by gravity and/or as applied to the lid L by a user to prevent or at least resist slamming of the lid L against the body B when the lid moves from an opened position to its closed position. FIGS. 5A and 5B show one example of a suitable snubber 40, which is a self-contained damper cylinder that uses air, oil or another damping fluid and/or that uses a mechanical spring for damping.

As shown, the snubber 40 comprises a snubber body 42 including a bore 44 defined therein and in which the damping fluid and/or mechanical damping spring is located. A first end wall 42*a* is connected to or otherwise provided as part of the snubber body 42 and closes a first end 44*a* of the snubber bore 44. A piston 46 is slidably located in the bore 44 and a piston rod 46*r* is connected to and projects outwardly from the piston 46 through the end wall 42*a*. The piston 46 is slidable between an extended position where it is located close to the end wall 42*a* and the piston rod 46*r* extends through and outwardly away from the end wall 42*a* (as shown in FIG. 5A) and a retracted position where the piston 46 is moved away from the first end wall 42*a* toward a second end wall 42*b* of the snubber body 42 that is spaced from the first end wall 42*a* and that closes an opposite inner or second end 44*b* of the snubber bore 44 as compared to the first end wall 42*a* and where the piston rod 46*r* is moved or retracted at least partially into the bore 44 (as shown in FIG. 5B) such that the piston rod 46*r* projects outwardly from the first end wall 42*a* to a lesser extent as compared to the extended position or is completely retracted into the bore 44 so that it does not project outwardly from the first end wall 42*a*.

A piston return spring 44*s* (shown in FIGS. 5A & 5B but not shown in FIGS. 4A-4C), such as a coil spring, is operatively located in the bore 44 between the second end wall 42*b* and the piston 46 and urges or biases the piston 46 toward its extended position. In another embodiment, the piston return spring 44*s* is additionally or alternatively provided external relative to the snubber body 42, i.e., located outside the body 42/bore 44 as partially shown in broken lines at 44*s*' and is coaxially position about the piston rod 46*r* and operatively engaged between the body 42 and an enlarged head 46*h* or other part of the tip or outer end of the piston rod 46*r*. The oil, air, or other damping fluid is located in the snubber bore 44. Snubber activation force such as inwardly directed axial force exerted on an outermost end of the piston rod 46*r* in a direction toward the second end wall 42*b* and/or an opposite force exerted on the snubber body 42 causes the piston 46 to move toward its retracted position, and the action of the damping fluid on the piston 46 resists or damps such inward movement of the piston 46, i.e., the piston 46 includes an orifice or other restricted flow path for the damping fluid to pass through or around the piston to provide resistance to inward movement of the piston. When the snubber activation force or forces acting on the snubber 40 are removed, the piston return spring 44*s* urges the piston 46 back to its extended position. Preferably, the piston 46 is configured such that the damping fluid passes through and/or around the piston with less resistance when the piston is moving outward from its retracted position toward its extended position, as compared to when the piston 46 is moving inward from its extended position toward its retracted position. Accordingly, the snubber 40 provides greater damping force during movement of the piston from its extended position toward its retracted position as compared to movement of the piston 46 in the opposite direction, which ensures that the piston 46 will move more quickly and easily from its retracted position to its extended position under force of the return spring 44*s* to reduce the time required for the snubber to reset (the time required for the piston 46 to become fully extended again from its retracted position) after removal of the snubber activation force(s).

In the illustrated embodiment, the snubber 40 is operatively connected to the base 10 by insertion of the snubber body 42 into the snubber installation bore 30 of the base 10. As shown, the snubber body 42 is reciprocally linearly movable relative to the base 10 in the snubber installation bore 30 on a snubber axis Y that is oriented perpendicularly but offset from the lid pivot axis X to and between a first (extended) position (FIG. 4A) and a second (retracted) position (FIG. 4C) through in intermediate position (FIG. 4B). In its second position, the snubber body 42 is moved into the snubber installation bore 30 toward the bore inner wall 32, and in its first position, the snubber body 42 is moved outwardly away from the bore inner wall 32 toward the cam lobe 24. As shown herein, the snubber 40 is oriented with its rod 46*r* directed or pointing into the snubber installation bore 30 toward the bore inner wall 32 and coaxially aligned with the locating stud 32*s*. In this arrangement, the piston rod 46*r* extends coaxially into the central core of the primary spring 34 and abuts the locating stud 32*s*, at least when the snubber 40 is urged into the bore 30 and activated as described below. In an alternative embodiment, the locating stud is omitted and the piston rod 46*r* abuts the bore inner wall 32, at least when the snubber 40 is urged into the bore 30 and activated as described below. In either case, the primary spring 34 engages the snubber body 42 and urges the snubber body 42 outwardly away from the bore inner wall 32. In the illustrated embodiment, the primary spring 34 biases the snubber body 42 into continuous abutment or engagement with the cam lobe 24 for all rotational positions of the cam 20 as can be seen in FIGS. 4A-4C to limit impact forces being exerted on the snubber body 42 by the cam lobe 24 as would occur if the cam lobe separated from the snubber body when the appliance lid is opened. Contact between the cam lobe 24 and the snubber body 42 also results in the primary spring 34 providing some continuous counterbalance force on the cam 20 that urges the cam 20 (and lid L engaged therewith) in the second (lid-opening) rotational direction to provide some assistance to manual opening of the lid L by a user and to provide some additional damping force during closing of the lid L as the cam rotates in the first direction against the biasing force of the primary spring 34.

In use, as shown in FIGS. 4A-4C, as the cam 20 rotates during movement of the lid L in the first or lid-closing direction from an opened position toward the closed position for the lid L, the cam lobe 24, which is preferably already directly in contact with the second end wall 42*b* of the snubber body 42 due to the biasing force of the primary spring 34, urges the snubber body 42 inward toward the bore inner wall 32 such that the piston rod 46*r* contacts the locating stud 32*s* if the piston rod is not long enough to already be in contact with the stud 32 and such that a snubber activation force is applied to the snubber 40 and the snubber thus exerts an opposite reaction damping force against the rotation of the cam 20 and cam lobe 24 to slow rotation of the cam 20. In particular, the cam lobe 24 urges the snubber body 42 inward from the position shown in FIG. 4A toward the bore inner wall 32 against the biasing force of the primary spring 34 such that the piston rod 46*r* contacts the locating stud 32*s* (or the bore inner wall 32 if the stud 32*s* is omitted) as shown in FIG. 4B. Continued movement of the lid L in the closing direction causes the cam lobe 24 to move the snubber body 42 further inward toward the bore inner wall 32 against the biasing force of the primary spring 34, but the piston rod 46*r* is blocked by the locating stud 32*s* from further movement toward the bore inner wall 32. Continued inward movement of the snubber body 42 by the cam lobe 24 thus causes the piston 46 to move through the damping fluid located in the snubber bore 44 from its extended position (FIG. 4B) to its retracted position (FIG. 4C) such that the snubber 40 resists and damps movement of lid L in the closing direction until the lid L is moved completely to its closed position as shown in FIG. 4C (the compression of the primary spring 34 as described above also provides some damping resistance force). Advantageously, the snubber 40 and/or primary spring 34 do not exert sufficient force on the cam lobe 24 to rotate the cam 20 in the second (lid-opening) direction spontaneously as would result in the appliance lid partially opening with undesired effect as described above. In an alternative embodiment, the cam lobe 24 separates from the snubber body 42 when the cam is rotated fully in the second (lid-opening) direction.

Upon movement of the lid L in an opposite direction from its closed position toward its opened position, the cam 20 will rotate in the opposite direction such that the cam lobe 24 moves away from the bore inner wall 32 which results in the primary spring 34 moving the snubber body 42 away from the bore inner wall 32 and which results in removal of the snubber activation force which allows the piston return spring 44*s* to move the piston from its retracted position (FIG. 4C) to its extended position (FIG. 4A). In an alternative embodiment, the primary spring 34 is omitted in which case the piston return spring 44*s* acts to move the snubber body 42 away from the bore inner wall 32 to reset the snubber upon removal of the snubber activation force.

In an alternative embodiment, the orientation of the snubber 40 in the installation bore 30 is reversed such that the piston rod 46*r* projects out of the open end 30*b* of the snubber installation bore 30 and is engaged by the cam lobe 24 when the lid L is moved in the closing direction from an opened position to the closed position. In such case, the second end wall 42*b* of the snubber body will compress the primary spring 34 and move into abutment with the locating stud 32*s* (or into abutment with the bore inner wall 32 if the locating stud 32*s* is omitted) during the initial stages of closing movement of the lid L, and further closing movement of the lid L will then cause the cam lobe 24 to push the piston rod 46*r* inwardly toward the second end wall 42*b* of the snubber body 42 so that the piston 46 is urged from its extended position toward its retracted position to provide the required damping. As noted above, the primary spring 34 is optionally omitted in this embodiment in which case the snubber body 42 abuts the bore inner wall 32.

Figure 6:
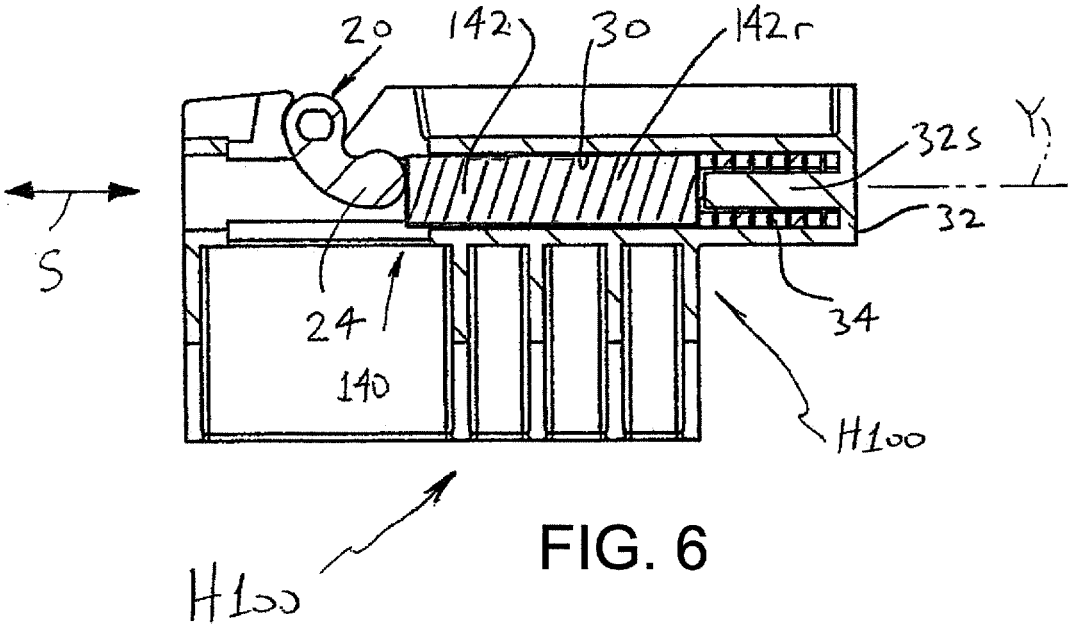
FIG. 6 is a section view similar to FIG. 4C of a hinge assembly provided in accordance with an alternative embodiment wherein the snubber of FIGS. 5A and 5B is replaced by an alternative snubber including a snubber rod engaged with a spring to provide a rod-snubber damped hinge assembly.

In still another alternative embodiment as shown in FIG. 6, the snubber 140 includes a snubber body 142 comprising a snubber rod 142*r* located in the snubber bore 30 and engaged with the primary spring 34 to provide a rod-snubber hinge assembly H100. The snubber rod 142*r* is movable relative to the base 10 in the snubber bore 30 along the snubber axis Y in a linear reciprocal manner as indicated by the arrow S between a first (extended) position and a second (retracted) position. In its second position as shown in FIG. 6, the snubber rod 142*r* is moved into the snubber installation bore 30 toward the bore inner wall 32, and in its first position, the snubber rod 142*r* is moved outwardly away from the bore inner wall 32 toward the cam lobe 24. In such case, the cam lobe 24 engages the snubber rod 142*r* and exerts a snubber activation force on the snubber rod 142*r* when the cam rotates in the first direction in response to movement of the lid L in the closing direction from an opened position toward the closed position (the closed position is shown in FIG. 6) and moves the snubber rod 142*r* inwardly from its first position toward the bore inner wall 32 to its second position against the biasing force of the primary spring 34 such that the primary spring 34 resists and damps movement of the lid L in the closing direction. The primary spring 34 also provides some counterbalance force to urge the snubber rod 142*r* outwardly toward its first position away from the bore inner wall 32 and urges the cam lobe 24 in its second rotational direction to assist in movement of the lid L in the opening direction toward the opened position.

The appliance A can use only one snubber hinge assembly H, as either the first or second hinge assembly H1,H2, in which case the other hinge H1,H2 assembly is provided by any other suitable hinge structure or assembly. Alternatively, both the first and second hinge assemblies H1,H2 are provided by a snubber hinge assembly H constructed in accordance with the present development as shown in FIG. 3 and/or as a mirror image as described above. In still another alternative embodiment, one of the hinge assemblies H1,H2 is provided by a snubber hinge assembly H as shown in FIG. 3 while the other hinge assembly H1,H2 is provided by a rod-snubber hinge assembly H100 as shown in FIG. 6.

The present development has been described with reference to preferred embodiments. Modifications and alterations will occur to those of ordinary skill in the art to which the present development pertains, and it is intended that the claims be construed as broadly as possible to encompass all such modifications and alterations while preserving the validity of the claims.

The invention claimed is:

1. A hinge assembly for pivotally connecting an associated appliance lid to an associated appliance body, said hinge assembly comprising:

a one-piece polymeric base adapted to be connected to the associated appliance body, said base comprising a mounting flange including one or more mounting apertures and comprising a snubber installation bore, wherein a first end of said snubber installation bore is at least partially closed by an inner wall of said base, said base further comprising an upper portion including first and second spaced-apart support walls and a slot defined between the first and second support walls, said first and second support walls comprising respective notches that are aligned with each other such that said notches of said first and second support walls cooperate to define a cam-receiving recess in said polymeric base;

said snubber installation bore of said base comprising a second end located opposite said first end and in open communication with said slot;

a cam rotatably supported in said cam-receiving recess of said base, said cam adapted to be engaged by the associated appliance lid and rotatable about a lid pivot axis, said cam comprising a camshaft comprising opposite ends respectively support for rotation in said respective notches of said first and second support walls such that said camshaft is supported in said cam-receiving recess for rotation relative to said base about said lid pivot axis, said cam further comprising a lobe that projects outwardly from the camshaft and that rotates with the camshaft about the lid pivot axis, said lobe of said cam located in said slot for at least some angular positions of said cam about said lid pivot axis;

a snubber operatively connected to the base, said snubber comprising: (i) a snubber body including a bore defined therein; (ii) a piston slidably located in the snubber body bore and a piston rod connected to and projecting outwardly from the piston through a first end wall of the snubber body, said piston slidable to and between an extended position and a retracted position, wherein said piston is located closer to said first end wall of said snubber body and said piston rod projects outwardly away from the first end wall of the snubber body to a greater extent when said piston is located in said extended position as compared to when said piston is located in said retracted position; (iii) a second end wall that is spaced from the first end wall such that said piston is slidably located between said first end wall and said second end wall; (iv) a piston return spring that urges the piston toward its extended position; and, (v) a damping fluid located in said snubber body bore and acting on said piston;

said snubber body positioned in said snubber installation bore of said base and adapted for reciprocal linear sliding movement in said snubber installation bore toward and away from said inner wall;

said hinge assembly further comprising a primary spring operatively positioned in said snubber installation bore between said inner wall of said snubber installation bore and said snubber body and biasing said snubber body away from said inner wall toward a first position;

wherein said lobe of said cam moves on an arc relative to said base about the lid pivot axis and said lobe of said cam is in contact with said second end wall of said snubber body in said slot and exerts a snubber activation force on said snubber when said camshaft rotates about said lid pivot axis in a first direction corresponding to movement of the associated appliance lid from an opened position toward a closed position and such that said snubber body is moved by said lobe of said cam in said snubber installation bore toward said inner wall of said snubber installation bore against said biasing of said primary spring and said piston moves inside said snubber body bore from said extended position toward said retracted position through said damping fluid whereby said snubber damps movement of said cam when said camshaft rotates in said first direction;

said piston return spring urging said piston toward its extended position and said primary spring urging said snubber body away from said inner wall of said base to reset the snubber when the snubber activation force is removed from said snubber.

2. The hinge assembly as set forth in claim 1, wherein the piston is configured such that the damping fluid passes by the piston with less resistance when the piston is moving from its retracted position toward its extended position as compared to when the piston is moving from its extended position toward its retracted position such that said snubber provides greater damping force during movement of the piston from its extended position toward its retracted position as compared to movement of the piston from its retracted position toward its extended position.

3. The hinge assembly as set forth in claim 1, wherein said piston return spring is operatively located in the snubber body bore between the second end wall and the piston.

4. The hinge assembly as set forth in claim 1, wherein said piston return spring is located external relative to said snubber body and is operatively located between the snubber body and an outer end of said piston rod.

5. The hinge assembly as set forth in claim 1, wherein said primary spring biases said second end wall of said snubber body outwardly away from said inner wall of said snubber installation bore into continuous abutment with the cam lobe for all operative positions of said cam.

6. The hinge assembly as set forth in claim 1, wherein said hinge assembly is operatively connected to an appliance, said appliance comprising:

an appliance body including a chamber with an open mouth; and, a lid for selectively covering the open mouth of the chamber;

wherein said base of said hinge assembly is connected to said appliance body by one or more fasteners respectively received in said one or more mounting apertures of said mounting flange, and wherein said lid is connected to said cam such that said hinge assembly pivotally connects the lid to the appliance body for movement of the lid between opened and closed positions.

* * * * *